US006880670B2

(12) United States Patent
Dondi

(10) Patent No.: US 6,880,670 B2
(45) Date of Patent: Apr. 19, 2005

(54) MUFFLER FOR SUCTION SYSTEM EXHAUST AIR USED WITH AN AUTOMATIC CUTTING MACHINE

(76) Inventor: Beda Charles Dondi, 1225 Middle River Dr., Fort Lauderdale, FL (US) 33304

( * ) Notice: Subject to any disclaimer, the term of this patent is extended or adjusted under 35 U.S.C. 154(b) by 0 days.

(21) Appl. No.: 10/065,539

(22) Filed: Oct. 29, 2002

(65) Prior Publication Data

US 2004/0079582 A1 Apr. 29, 2004

(51) Int. Cl.[7] ..... F01N 1/10; F01N 1/24; F01N 7/02; F01N 1/04

(52) U.S. Cl. ..... 181/269; 181/222; 181/225; 181/232; 181/251; 181/252; 181/256

(58) Field of Search ..... 181/269, 265, 181/272, 275, 278, 282, 283, 222, 225, 232, 246, 251, 252, 255, 256, 257, 263, 231; 15/326

(56) References Cited

U.S. PATENT DOCUMENTS 1,859,400 A * 5/1932 Kersey ..... 181/278
2,037,884 A * 4/1936 Day ..... 181/229
2,675,088 A * 4/1954 McLeod ..... 181/265
2,721,619 A * 10/1955 Cheairs ..... 181/244
3,340,954 A * 9/1967 Benjamen ..... 181/256
3,545,565 A * 12/1970 McCaffrey, Jr. ..... 181/256
3,651,888 A * 3/1972 Andres ..... 181/265
3,710,891 A * 1/1973 Flugger ..... 181/256
3,757,892 A * 9/1973 Raudman, Jr. ..... 181/256
4,082,160 A * 4/1978 Schilling et al. ..... 181/258
4,114,370 A * 9/1978 Woods ..... 60/279
4,143,739 A * 3/1979 Nordlie ..... 181/265
4,180,141 A * 12/1979 Judd ..... 181/264
4,239,091 A 12/1980 Negrao
4,241,805 A * 12/1980 Chance, Jr. ..... 181/232
4,290,501 A 9/1981 Tanaka
4,367,808 A * 1/1983 Oberg ..... 181/272
4,487,289 A * 12/1984 Kicinski et al. ..... 181/252
4,550,799 A * 11/1985 Flugger ..... 181/244
4,593,504 A * 6/1986 Bonnici et al. ..... 52/199
4,880,078 A * 11/1989 Inoue et al. ..... 181/232
5,067,584 A * 11/1991 Williams et al. ..... 181/231
5,246,473 A * 9/1993 Harris ..... 96/386
5,262,600 A * 11/1993 Woods ..... 181/227
5,626,066 A 5/1997 Lallement
5,765,257 A * 6/1998 Steger et al. ..... 181/256
5,859,393 A * 1/1999 Cummins et al. ..... 181/257
5,892,186 A * 4/1999 Flugger ..... 181/252
6,052,863 A * 4/2000 Rittmueller et al. ..... 15/326
6,202,785 B1 * 3/2001 Hilling et al. ..... 181/230
6,223,434 B1 5/2001 Morikawa
6,241,044 B1 * 6/2001 Nishiyama et al. ..... 181/272
6,543,577 B1 * 4/2003 Ferreira et al. ..... 181/282

* cited by examiner

*Primary Examiner*—Edgardo San Martin
(74) *Attorney, Agent, or Firm*—Malin, Haley & DiMaggio, P.A.

(57) ABSTRACT

A noise reduction system for significantly reducing the noise generated by an air turbine used to create suction for automatic cutting tables. The system employs one or more baffles mounted within a closed main housing including noise reduction foam and an exhaust housing lined with noise reduction foam mounted around the baffle exhaust. The direction of the exhaust air is changed 180 degrees and is utilized for cooling the air turbine and electric motor.

1 Claim, 4 Drawing Sheets

MUFFLER FOR SUCTION SYSTEM EXHAUST AIR USED WITH AN AUTOMATIC CUTTING MACHINE

BACKGROUND OF INVENTION

1. Field of the Invention

This invention relates generally to a muffler for reducing noise from the exhaust of an air turbine and specifically to a muffler for the exhaust from a vacuum device for use with an automatic cutting machine.

2. Description of Related Art

Cutting machines for fabric or fabric-like material use a table that includes a suction device for holding the fabric article to be cut flat on the table surface. The vacuum or suction is formed from a high-energy air turbine that draws air through small holes in a pervious sheet associated with the table surface resulting in a large volume high velocity air exhaust discharge from the air turbine during operation. The air turbine and exhaust generate high decibels of noise that can be very detrimental to employees in the local environment. Typically a cutting table is disposed indoors in a factory which can accentuate the noise problems in a closed in area. Oftentimes there is limited space in the factory environment requiring that the cutting table and its associative equipment occupy the least amount of space possible.

U.S. Pat. No. 4,239,091 issued on Dec. 16, 1980 shows a muffler used to reduce noise. The device shown is basically for an automobile car engine. U.S. Pat. No. 4,290,501 issued Sep. 22, 1981 shows an exhaust silencer especially for small vehicles. U.S. Pat. No. 6,223,434 issued May 1, 2001 shows a muffler and its manufacturing method again for an automobile engine. U.S. Pat. No. 5,626,066 issued on May 6, 1997 shows a suction device for an automatic cutting machine and the cutting method implementing the device. Although this device shows an exhaust sound box and silencer, the structure and operation are not sufficient to significantly reduce the high decibel noise found in most air turbines used with today's automatic cutting tables.

The present invention provides for a muffler system for two different size air turbines used with cutting tables that significantly reduces the noise surrounding the cutting table environment in a very compact structure and operation.

SUMMARY OF INVENTION

The present invention relates to a device to reduce the exhaust noise emanating from an automatic cutting machine. Automatic cutting machines comprise a flat cutting table upon which there is placed a stack of fabric or sheet material, a cutting tool that is movable over the stack of sheet material to be cut, and a suction device associated with a pervious film placed below the table top to hold the stack of sheet material down on the table during cutting. Typically a suction device is an air turbine that has an air inlet for suction and an air exhaust outlet that discharges high velocity air. The turbine is driven by an electric motor often fitted with fans for cooling. In order to hold the sheet material and fabric sheets on the table, a significant suction is generated on the face of the cutting table. As a result of the air exhaust from the turbine the surrounding area has intense noise from the high-energy air in the high decibel range. This is very hazardous to employees who must work in the area. In most instances, the cutting tables are in an area in a closed room in a factory of limited space.

The present invention comprises a device for reducing noise generated by an air turbine especially used as a suction device for an automatic cutting table comprising a first main housing which is essentially a hollow elongated conduit, an exhaust housing, and an internal baffle arrangement and noise reduction material to significantly reduce air exhaust noise. An air inlet to the main housing is connected to the turbine exhaust from the turbine. Noise reduction material is strategically mounted within the main housing and exhaust housing which interacts with the baffle elements.

The main housing air inlet from the turbine exhaust is connected to a first tubular baffle which is coaxially mounted inside and along the central axis of the main housing. The first baffle includes an intake open end and a plug or stop at the opposite end away from the inlet. The first baffle body has numerous small apertures throughout its length. A second different tubular baffle is mounted coaxially within said main housing downstream from said first baffle. One end of said second baffle is connected to said plug/stop that is also connected to said first baffle. Thus the first baffle and the second baffle are mounted along the same axis, adjacent each other, separated by the plug/stop. The second baffle has an open outlet end (opposite the plug end) that extends beyond the end of the main housing. The first baffle and second baffle each have numerous small apertures disposed throughout to allow air flow in and out through the baffle bodies. The inside circumferencial wall of the main housing (which is tubularly-shaped) includes a layer approximately one inch thick of noise reduction material disposed throughout its length. The main housing diameter may be twelve inches. The first baffle and the second baffle are each eight inches in diameter. The exhaust air from the turbine flows into the air inlet through a coupling directly into the first baffle through the first baffle holes into the central chamber of the main housing which includes the noise reduction material. The air flows and is diverted into the second baffle from the outside to the inside through the second baffle holes where the air exits into the exhaust housing.

The exhaust housing, mounted coaxially downstream of the main housing, is a rigid circular container having an open top that is coaxially mounted to the central circular axis of the main housing. The exhaust housing includes a two inch layer of noise reduction foam disposed around its insides cylindrical walls and the inside base (closed and sealed bottom) forming the inside cavity of the exhaust housing. The outside diameter of the main housing is smaller than the inside diameter of the exhaust housing including the foam layer in the exhaust housing such that there is an annular ring formed between the main housing outside surface and the inside surface of the foam in the exhaust housing to permit air to exhaust and exit after traversing an approximate one hundred eighty degree change of direction from its intake through the first and second baffles. This exhaust air which is greatly reduced in noise is then diverted towards the air turbine and electric motor driving the air turbine for cooling purposes.

The noise reduction system in accordance with the present invention is typically mounted horizontally beneath the cutting table itself in line with the air turbine and electric motor. Because of this compact size, the present invention does not take up additional space and can be operated beneath the table itself.

In an alternate embodiment, for much larger turbines and electric motors having 25 horsepower or more, the present invention can be mounted vertically to include a cylindrically shaped rigid exhaust housing containing a first large rectangular baffle having numerous small apertures for diverting exhausting air connected directly to the exhaust duct of the large turbine. The exhaust housing enclosing the baffle is mounted vertically and includes an extremely large interior chamber that receives outlet air from the upstream rectangular baffle. The exhaust housing can be a cylindrically-shaped container having an open, lower end that is coaxially mounted with the rectangular inlet baffle disposed along the longitudinal central axis of the exhaust housing. The inside cylindrical wall of the exhaust housing is lined with two inches of noise reduction foam. The exhaust duct from the turbine is rectangular and is connected directly to the baffle. In the alternate embodiment, the turbine exhaust air comes through the baffle, passing from the inside to the outside of the baffle though holes in the baffle, into the exhaust housing, changing direction 180 degrees and finally exiting out through openings in the lower end of exhaust housing back towards the turbine. The air is directed against the air turbine and electric motor for cooling purposes. Even though this is a large turbine and electric motor, the size and volume of the present invention fits well because it is mounted above the turbine and engine assembly for compactness without requiring additional space throughout the factory floor.

The use of the present invention has shown to greatly diminish decibels of noise experienced in the environment for medium and large size turbines used with cutting tables in a factory environment. The invention is very compact, is low in cost to manufacture and significantly improves the environment by reducing noise for workers.

It is an object of the invention to provide an improved noise reduction system for use with vacuum-actuated sheet material and fabric cutting tables.

It is another object of this invention to provide an improved muffler and sound reduction for air turbines used to create suction in a factory environment to greatly reduce the noise level to human beings.

And yet still another object of this invention is to provide a very compact noise reduction system for use in a factory environment for enhanced noise reduction of noise generated by an air turbine typically used to provide suction to an automatic fabric cutting table.

In accordance with these and other objects which will become apparent hereinafter, the instant invention will now be described with particular reference to the accompanying drawings.

DETAILED DESCRIPTION

Figure 1:
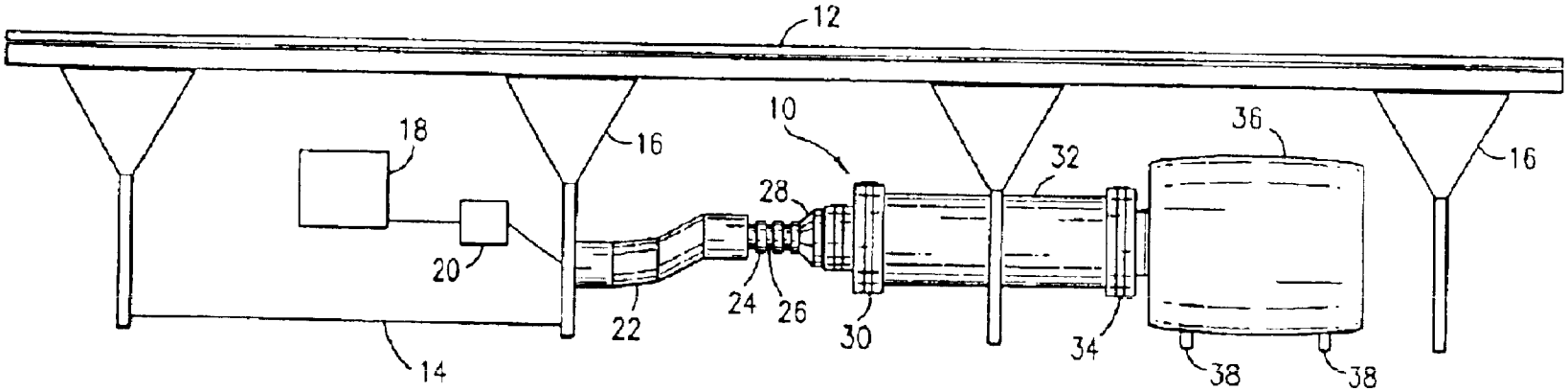
FIG. 1 shows a side elevational view of the present invention mounted under an automatic cutting table.

Refering now to the drawings and in particular to FIG. 1, the present invention is shown generally at 10 as a noise reduction system connected to a turbine 20 driven by electric motor 18 both of which are mounted under automatic cutting board table 12 behind a single baffle board 14. The turbine 20 has an exhaust conduit 22 and delivers high velocity air from the suction environment used to provide suction to table 12. The table is supported horizontally by vertical legs 16. The turbine 20 exhaust conduit 22 is in fluid communication and connects to the noise reduction system 10 though pipe couplings 24, 26 and 28. The inlet conduit 28 is connected to main housing end plate 30. The main housing 32 of the present invention is a large tubular, hollow conduit made of a rigid plastic material that is airtight and connected on the outlet side to end plate 34. An exhaust housing 36 is mounted at the outlet end of main housing 32 and supported by leg members 38 for mounting purposes.

FIG. 1 shows how compact the invention 10 is as shown mounted beneath table 12. In operation, motor 18 drives air turbine 20 to provide suction to the tabletop 12 and exhaust air at high velocity through exhaust 22. The noisy exhaust air from the turbine is directed through main housing 32 into the exhaust housing 36 where the air reverses direction 180 degrees and is discharged out the front of the annular opening around exhaust housing 36. The discharged air is directed back towards the area underneath the table 12 for cooling the motor and turbine.

Figure 2:
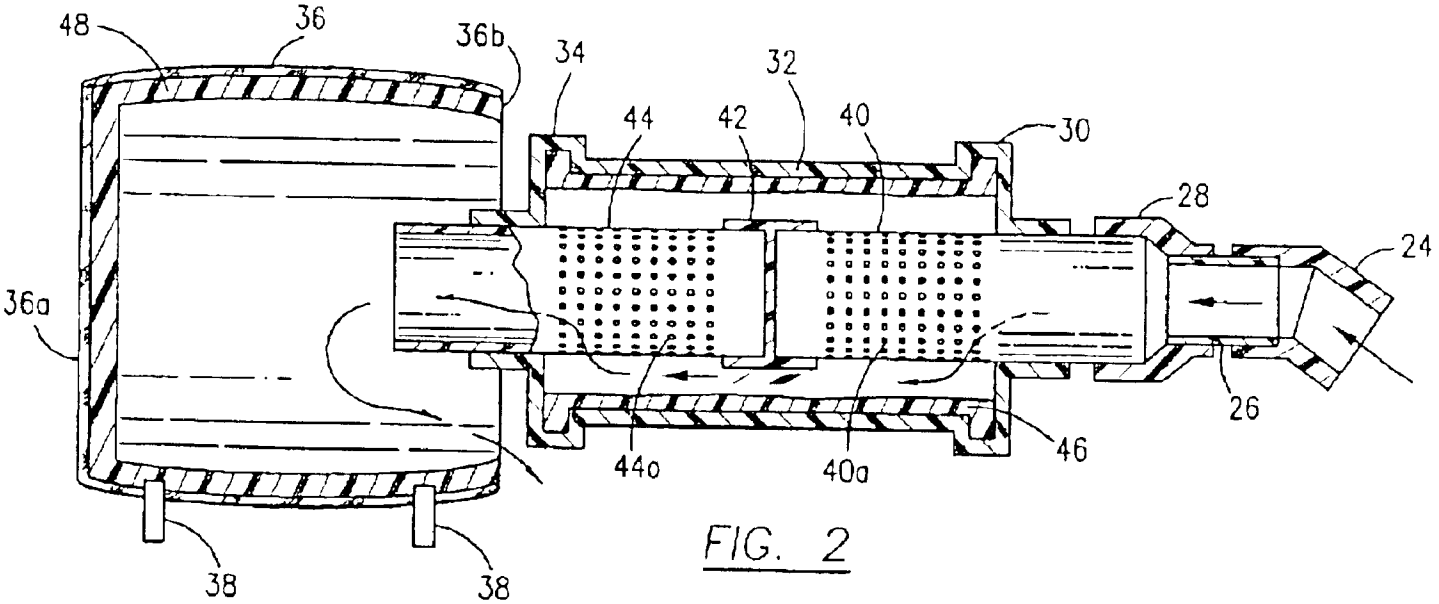
FIG. 2 shows a side elevational of view of the present invention, partially cut away.

Referring now to FIG. 2, the main housing 32 has disposed coaxially therein a first cylindrical baffle 40 including a plurality of holes or apertures 40*a*. Each aperture is approximately 0.65 inches in diameter. The baffle 40 is connected at its intake end through sealed end plate 30 and at the opposite end to a plug/stop sleeve 42. A second baffle 44 is a cylindrical conduit having a plurality of apertures 44*a* connected at one end to plug/stop sleeve 42 coaxially aligned with baffle 40. Each aperture is approximately 0.65 inches in diameter. The cylindrical main housing 32 is a rigid plastic or PVC pipe 12 inches in diameter and includes a one inch layer of noise reduction foam 46 disposed completely around its inside wall or surface. The main housing 32 is sealed at both ends to end plates 30 and 34. The internal baffle 40 is also sealably connected through end plate 30. Baffle 44 is sealably connected at its outlet end through end plate 34. The outlet end of the baffle 44 is mounted within the inside chamber of exhaust housing 36. The exhaust housing 36 is a large cylindrical plastic container with closed sealed end 36*a* and annular opening 36*b*. The inside wall surfaces of exhaust housing 36 including the end inside wall 36*a* are covered with a layer of two inch noise reduction foam.

Figure 3:
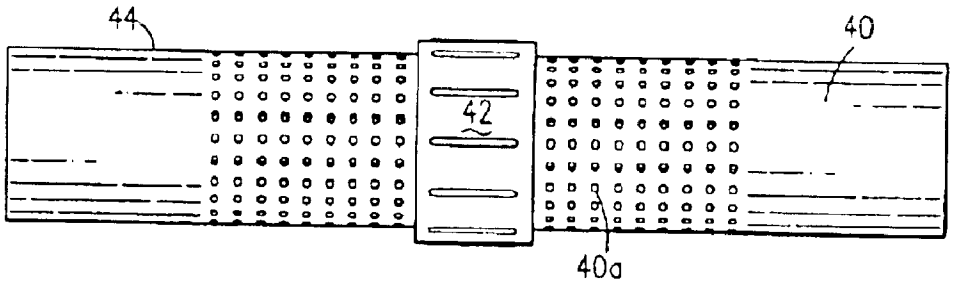
FIG. 3 shows a side elevational view of the internal baffle used in the present invention.

In operation, the noise reduction system 10 shown in FIGS. 1–3 provides for turbine air exhaust entering the exhaust air inlet pipe coupling 24. Air is transferred into the present invention 10 through pipe coupling 28 into the main housing 32. Actually the exhaust air is received directly into baffle 40 which includes the plurality of holes 40*a* that allows the air to be directed through the apertures 40*a* into the main housing 32. Once in the central chamber of the main housing 32, the air is directed into baffle 44 through the numerous holes 44*a* in baffle 44. The air then exits baffle 44 through an open end outlet and is received into the exhaust housing 36 where the air reverses direction 180 degrees. The inside of the exhaust housing 36 includes a two-inch layer of noise reduction foam 48 for noise reduction. The air that is exhausted through the annular opening 36*b* in the exhaust housing 36 is directed somewhat parallel to the invention main housing 32 towards the turbine and motor for cooling purposes.

Referring now to FIG. 3, first baffle 40 is shown having a tubular body with a plurality of holes 40*a*. The down stream end is mounted to a plug/stop sleeve 42 which also is attached to second baffle 44 along the same axis. The sleeve 42 acts as a cylindrical coupling and plug that prevents air from flowing through plug/stop sleeve 42. Air inside the first baffle 40 is directed into the main housing 32 internal chamber and down stream into second baffle 44. The air in baffle 44 exits through the outlet end of baffle 44 into the exhaust housing 36.

Figure 4:
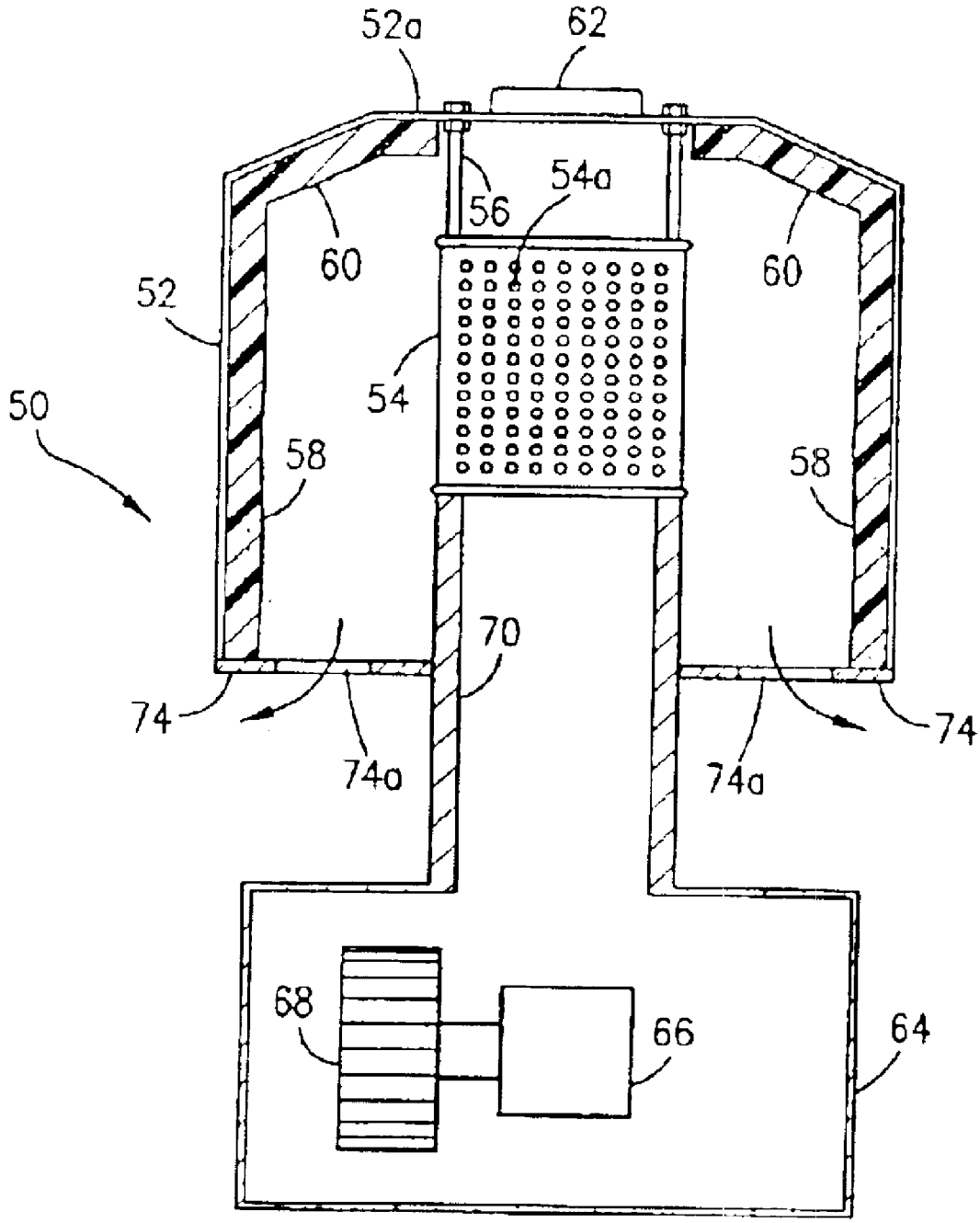
FIG. 4 shows a side elevational view in cross-section of the alternate embodiment of the present invention.

Referring now to FIG. 4, an alternate embodiment of the invention is shown. The purpose of the alternate embodiment to the invention is to provide noise reduction for a much larger turbine having much larger airflow than the smaller turbine shown above, which is about seven horsepower (HP) versus twenty-five HP in the larger unit. Because the air turbine and electric motor are much larger and produce more noise energy, available space limitations also must be carefully monitored. As shown in FIG. 4, the present invention 50 provides for noise reduction using a very large cylindrical container-shaped housing 52 which is the exhaust housing in conjunction with a rectangular air inlet baffle that is supported vertically on and by the turbine exhaust duct equipment 70 connected to the housing 64 for the turbine 68 and electric motor 66. The exhaust rectangular duct 70 has four flat sides that are rigid that support the light weight noise reduction unit 50. Duct 70 is in direct fluid communication and opens directly into the rectangular baffle 54 constructed of four rectangular flat rigid panels 54 having a plurality of holes 54*a* on all four sides. The exhaust housing 52 is a large plastic or fiberglass cylindrical container-shaped housing having a top closed end 52*a* with a removeable lid 62 for access into the housing 52. The housing 52 is supported and connected to four vertical rods 56 connected to the top of baffle 54. The rods are bolted to the housing 52.

Figure 5:
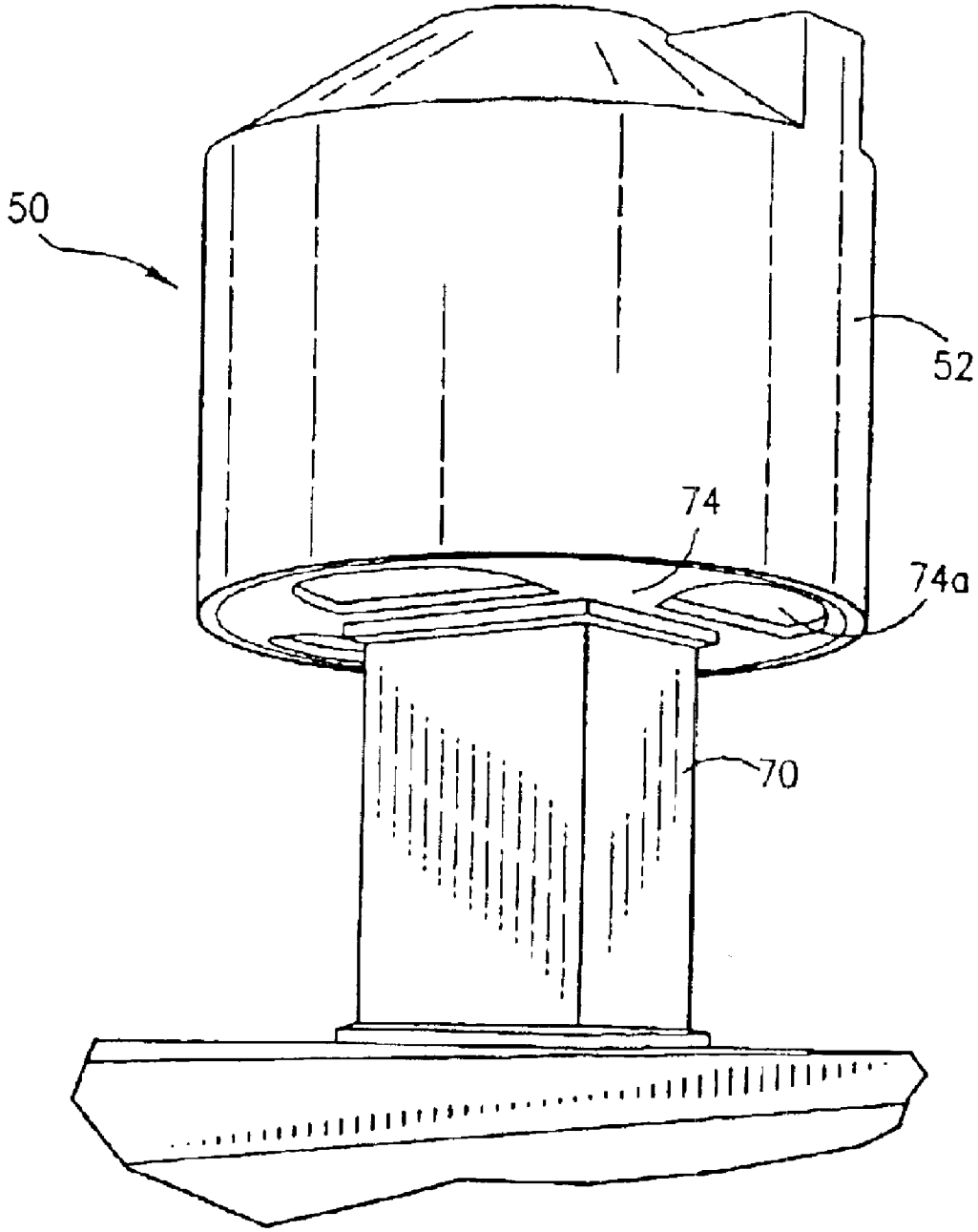
FIG. 5 shows the alternate embodiment of the present invention in a perspective view.

The exhaust housing 52 includes a plurality (four) of exhaust plates 74, each having a port 74*a* to allow exhaust air to exit the noise reduction system 50 in a downward direction (see FIG. 5).

The inside walls of the exhaust housing 52 include a layer of noise reduction foam 58 along its inside cylindrical wall and a layer of noise reduction foam 60 along the top wall 52*a*. Lid 62, when closed, is tightly sealed to prevent air leakage.

Turbine 68 driven by electric motor 66 (which may be 25 horsepower) provides high velocity, high energy exhaust air through exhaust duct 70 which is received into baffle 54 mounted centrally and vertically within the inside of exhaust housing 52. The air travels through apertures 54*a* into the interior of exhaust housing 52 that is lined with noise reduction foam 58 and 60 throughout. The exhaust air then reverses direction one hundred eighty degrees and is exhausted out through four ports 74*a* in exhaust housing 52. The air is directed downward towards electric motor 66 and turbine 68 for cooling purposes.

The alternate embodiment of the invention is shown in FIG. 5 in perspective and includes the cylindrically-shaped exhaust housing 52 mounted on top of the air turbine rectangular duct 70. The exhaust housing 52 includes a bottom exhaust plate 74 having four ports 74*a* (one for each side of each inside baffle wall connected to the air turbine exhaust duct 70). FIG. 5 illustrates the space saving nature and compactness of the present invention. Also the noise reduction system provides cooling air for the turbine and motor. The alternate embodiment shown in FIG. 5 is especially useful for noise reduction involving very large volumes of air and noise energy.

The present invention has been shown to provide noise reduction of several decibels when used with the exhaust from air turbines that provide suction for automatic cutting tables. The present invention is a compact installation and relatively inexpensive to manufacture from readily available off-the-shelf components. The present invention can be mounted in any industrial work area for cutting tables without adding extra space requirements while significantly reducing noise emanating., from the turbine exhaust system for the benefit of workers in a confined space.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A noise reduction system for use with a vacuum generating device that includes an air turbine to reduce the noise generated by the exhaust air from the air turbine when used with an automatic cutting table comprising:

an automatic cutting table;

an air turbine for generating a vacuum for said automatic cutting table, said air turbine having noisy exhaust air and an exhaust air outlet;

a first turbine exhaust air noise reduction member having a cylindrical main housing including a turbine exhaust air inlet conduit and an exhaust air outlet conduit;

a cylindrical baffle mounted coaxially inside said cylindrical main housing;

an exhaust air barrier mounted fully across the inside of said cylindrical baffle, near the longitudinal center of said cylindrical baffle, said cylindrical baffle having a first cylindrical body section having a plurality of apertures and a second cylindrical body section having a plurality of apertures, said first cylindrical body section separated from said second cylindrical body section by said exhaust air barrier;

said cylindrical baffle first body section in direct fluid communication with said main housing turbine exhaust air inlet conduit;

said cylindrical baffle second body section in fluid communication with said exhaust air outlet conduit from said cylindrical main housing;

said cylindrical main housing having an inside curved wall;

a solid composite noise reduction foam surrounding the inside curved wall of said cylindrical main housing and surrounding said coaxially mounted baffle;

a second cylindrical housing having a diameter larger than said first main cylindrical housing and a curved inside wall surface;

said second cylindrical housing having a cylindrical body and a closed end and an open end;

a solid composite noise reduction foam attached to and surrounding the inside wall surface and the closed inside end of said second cylindrical housing;

said cylindrical main housing outlet exhaust conduit mounted coaxially inside said second cylindrical housing and in fluid communication with the inside of said second cylindrical housing and said noise reduction foam in said second cylindrical housing; and said second cylindrical housing open end surrounding said main cylindrical housing outlet exhaust air conduit allowing exhaust air exiting the main cylindrical outlet exhaust conduit to contact the composite noise reduction foam in said second cylindrical housing and to reverse direction and exit the second cylindrical housing open end thereby providing noise reduction for the air turbine exhaust air.

* * * * *